US008808796B1

(12) United States Patent
Nichols et al.

(10) Patent No.: US 8,808,796 B1
(45) Date of Patent: Aug. 19, 2014

(54) METHOD OF PRETREATING ALUMINUM ASSEMBLIES FOR IMPROVED ADHESIVE BONDING AND CORROSION RESISTANCE

(71) Applicant: Ford Global Technologies, LLC, Dearborn, MI (US)

(72) Inventors: Mark Edward Nichols, Saline, MI (US); Janice Lisa Tardiff, Plymouth, MI (US); Brian Schneider, Royal Oak, MI (US); Steven J. Simko, Shelby Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/751,412

(22) Filed: Jan. 28, 2013

(51) Int. Cl.
*B05D 5/10* (2006.01)

(52) U.S. Cl.
USPC ..... 427/208.6; 427/207.1; 156/196; 156/280; 156/281

(58) Field of Classification Search
CPC ..... B21J 3/00; C09J 2400/163; C23C 22/38; B05D 7/52
USPC ..... 427/207.1, 208.6; 156/196, 280, 281
See application file for complete search history.

(56) References Cited

U.S. PATENT DOCUMENTS 4,869,764 A * 9/1989 Marwick ..... 156/196
5,059,258 A 10/1991 Wefers et al.
6,562,148 B1 5/2003 Wendel et al.
7,208,053 B2 4/2007 Wietzoreck et al.
7,736,730 B2 6/2010 Jung et al.
2004/0163736 A1 8/2004 Matsukawa et al.
2005/0205167 A1 9/2005 Benmalek et al.
2007/0026254 A1 2/2007 Ben-Malek et al.
2010/0183820 A1 7/2010 Seubert et al.

FOREIGN PATENT DOCUMENTS

EP 0687715 12/1995

OTHER PUBLICATIONS

The Aluminum Automotive Manual, Manufacturing—Surface Finishing, Version 2002, European Aluminum Association, pp. 1-39.
W.S. Miller et al., Recent Development in Aluminum Alloys for the Automotive Industry, Materials Science and Engineering A (2000), pp. 37-49.

* cited by examiner

*Primary Examiner* — Michael Cleveland
*Assistant Examiner* — Xiao Zhao
(74) *Attorney, Agent, or Firm* — Damian Porcari; Brooks Kushman P.C.

(57) ABSTRACT

A system and a method for pretreating an aluminum assembly includes selecting a blank having a thin film pretreatment layer and a lubricant coating applied to a surface. The blank is formed to a desired shape and an adhesive is applied to a selected portion of the surface. A cleaner is applied to the assembly to remove the thin film pretreatment layer and the lubricant coating from the surface except at the selected portion and a zirconium oxide conversion coating is applied to the assembly before painting.

7 Claims, 3 Drawing Sheets

METHOD OF PRETREATING ALUMINUM ASSEMBLIES FOR IMPROVED ADHESIVE BONDING AND CORROSION RESISTANCE

TECHNICAL FIELD

This disclosure relates to a method of manufacturing and preparing aluminum body panels and other parts that use adhesives and sealants that are painted after application of a conversion coating.

BACKGROUND

Corrosion of aluminum alloys on vehicles is a complex and costly issue for vehicle manufacturers. Aluminum corrosion is generally associated with joints between parts, hem flanges and trimmed edges. As more aluminum is used in vehicle designs the potential for greater aluminum corrosion is an increasingly important issue. The root cause of aluminum corrosion is complex but is believed to relate to five key elements: surface finishing, paint shop-applied pretreatment, aluminum alloy chemistry, the presence or absence of a sealer, and craftsmanship (placement of adhesive, inner/outer overlap, inner/outer gap, burr size and orientation). All of the above elements must be addressed to achieve superior aluminum corrosion performance.

Manufacturing materials and processes are not solely optimized to provide the best aluminum corrosion performance. New vehicle designs are trending towards deeper draws and stronger alloys that necessitate the need for improved forming manufacturing methods and materials. Aluminum vehicles depend on substantial amounts of structural adhesive that is applied to parts being joined to provide the vehicle with the necessary strength and rigidity to improve noise, vibration and harshness (NVH) performance. The interaction between the aluminum surface, the forming lubes, and the adhesive must be balanced to provide an effective manufacturing process.

All aluminum surfaces normally have a native oxide/hydroxide layer due to the reactive nature of aluminum. The native oxide/hydroxide layer forms very rapidly when the aluminum is exposed to air. This reaction is self-passivating and results in a thin oxide/hydroxide layer. When pretreating an aluminum coil, an alkaline and/or acid etch is performed to remove the native oxide/hydroxide layer. A thin film pretreatment layer (such as Alcoa 951 a trademarked product of Alcoa Aluminum for a vinyl phosphonic/phosphinic acid, polyacrylate solution) may be applied to the newly etched surface. Some of the native oxide/hydroxide layer may reform on the surface before the Alcoa 951 is applied which is then modified by the Alcoa 951 pretreatment.

The general problem addressed is how to deliver superior formability, adhesive bond durability, and corrosion performance on an aluminum vehicle at high production volumes.

The above problems and other problems are addressed by the disclosed method as summarized below.

SUMMARY

According to one aspect of this disclosure, a method is provided for pretreating an aluminum assembly comprising selecting a blank having a thin film pretreatment functionalized coating (thin film pretreatment layer) and a lubricant coating applied to a surface of a coil prior to forming blanks into parts. The blank is formed to a desired shape and assembled with an adhesive or sealant being applied to a selected portion of the surface when the parts are joined. As used in this application the term "sealant" means an adhesive and is equivalent in that the sealant adheres to the surface like an adhesive. The assembly is cleaned with a cleaner including surfactants that is formulated to partially or completely remove the thin film pretreatment layer. The cleaner also substantially completely removes the lubricant coating from the surface except at the selected portion. A conversion coating is applied to the assembly as a final step prior to painting.

According to another aspect of this disclosure, a system is provided for pretreating a part formed from a blank that is coated with a thin film pretreatment layer and a lubricant coating. The part has an adhesive applied to a selected portion of the part, such as a hem flange joint, a structural adhesive joint, or a hem flange sealant. The system comprises a cleaner immersion tank for applying a cleaner to the part to remove the thin film pretreatment layer and the lubricant except where the adhesive or sealant is applied to the selected portion of the part. A series of other immersion tanks and spray tanks are provided for applying the conversion coating to the assembly.

According to other aspects of this disclosure relating to the disclosed method and system, the thin film pretreatment layer and the lubricant coating may be pre-applied to a coil that is cut to form the blanks that are formed into parts. The adhesive is applied to selected portions of the parts that are to be assembled and, in particular, to areas that receive a structural adhesive, hem flange adhesive, hem flange sealant, or the like. The selected portion may be two parts that are joined by a structural adhesive, a hem flange that receives hem flange adhesive, or a hem flange edge that is sealed with a hem flange sealant. The conversion coating may be a thin film zirconium oxide coating, or other type of conversion coating that is applied to promote paint adhesion and resist corrosion.

The above aspects of this disclosure and other aspects will be more fully described in the following detailed description.

DETAILED DESCRIPTION

Figure 1:
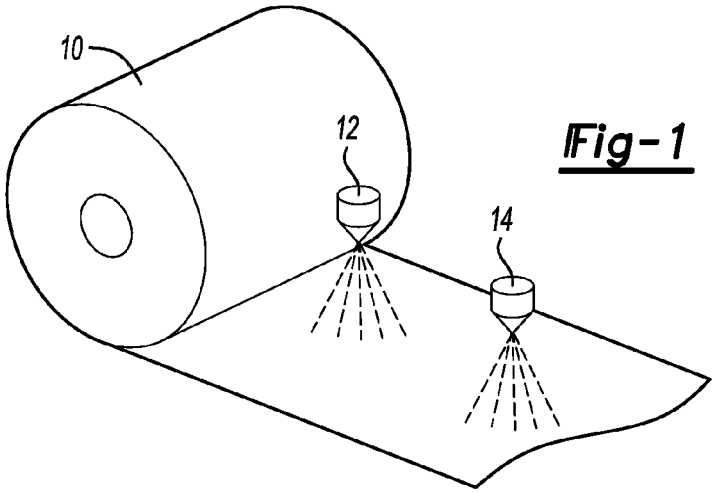
FIG. 1 is a diagrammatic view of a coil of aluminum that is diagrammatically shown as being spray coated with an thin film pretreatment layer and a dry lubricant coating, however, the coating may be applied in a bath or other well-known coating process.

The disclosed embodiments are intended to be merely examples that may be embodied in various and alternative forms. The specific structural and functional details disclosed are not to be interpreted as limiting, but as a representative basis for teaching one skilled in the art how to practice the disclosed concepts. The thickness of the thin film pretreatment layer, dry lubricant coating layer, adhesive deposits and sealant deposits are greatly exaggerated to be visible in the drawings.

Referring to FIG. 1, a coil 10 of aluminum sheet metal is illustrated diagrammatically that is coated by a thin film pretreatment layer application system 12 and by a dry lubricant coating application system 14 that applies a dry lubricant coating to the thin film pretreatment layer before the coil is shipped. The coating application systems 12 and 14 are diagrammatically illustrated as spray application systems, however, other application systems such as an immersion system or a multi-step immersion and spray application system could be used to apply the coatings.

Figure 2:
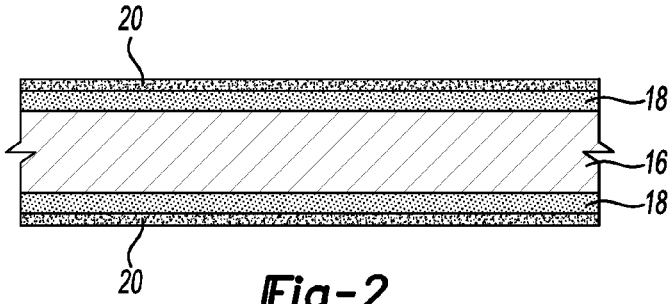
FIG. 2 is a cross-sectional view of a part of the coil with the thin film pretreatment layer and the dry lubricant coating.

Referring to FIG. 2, two aluminum sheets 16 are shown with a thin film pretreatment coating 18 and a dry lubricant layer 20. The thin film pretreatment coating 18 and the dry lubricant layer 20 are thin film layers that are enlarged for better visibility in FIG. 2. The thin film pretreatment coating 18 and the dry lubricant layer 20 are applied to two sides of the sheet 16 in the illustrated embodiment. The thin film pretreatment coating 18 provides a functionalized surface that improves adhesion of adhesives and sealants. The dry lubricant layer 20 provides lubrication and yields superior formability for forming a part 26 from the blank 24.

Figure 3:
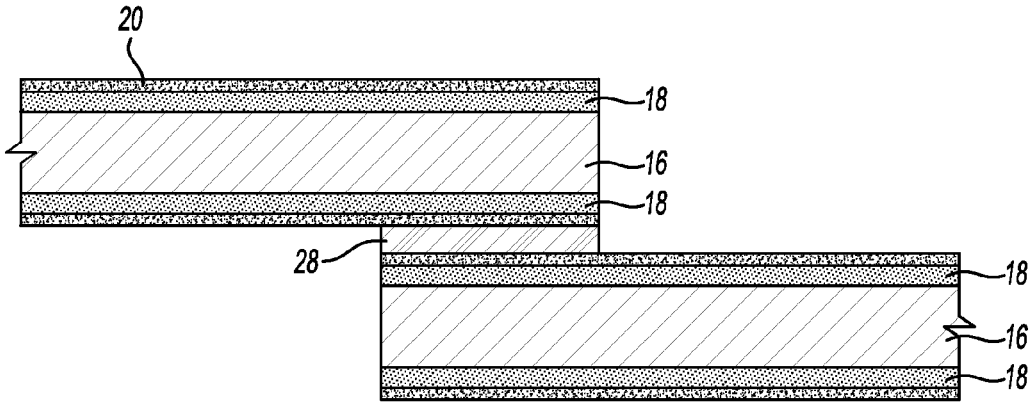
FIG. 3 is a diagrammatic cross-sectional view of a two sheet metal parts that are joined by a structural adhesive.
Figure 3A:
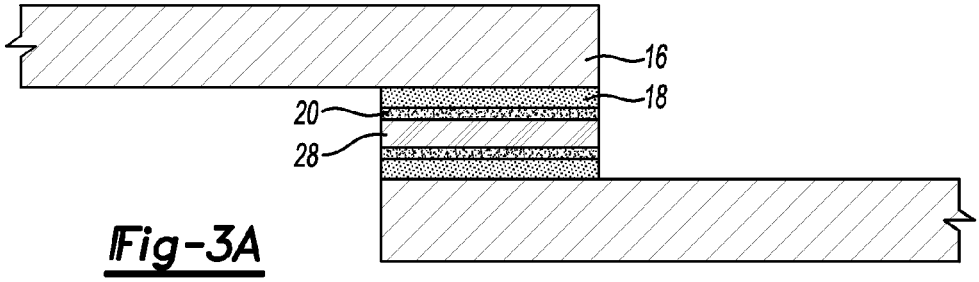
FIG. 3A is a diagrammatic cross-sectional view of a two sheet metal parts that are joined by a structural adhesive after being cleaned in a cleaner bath to remove the thin functionalized coating and dry lubricant coating.

Referring to FIG. 3, two parts 16 are illustrated that are assembled together with a structural adhesive 28. The structural adhesive 28 is applied to the thin film pretreatment coating 18 and the dry lubricant coating 20 in the area where the two parts 16 overlap in a lap joint. Referring to FIG. 3A, the two parts shown in FIG. 3 are shown after being cleaned in a paint shop cleaning immersion bath that removes the thin film pretreatment coating 18 and the dry lubricant coating 20 in all areas except where the structural adhesive 28 is bonded to the two parts 16 in the lap joint.

Figure 4:
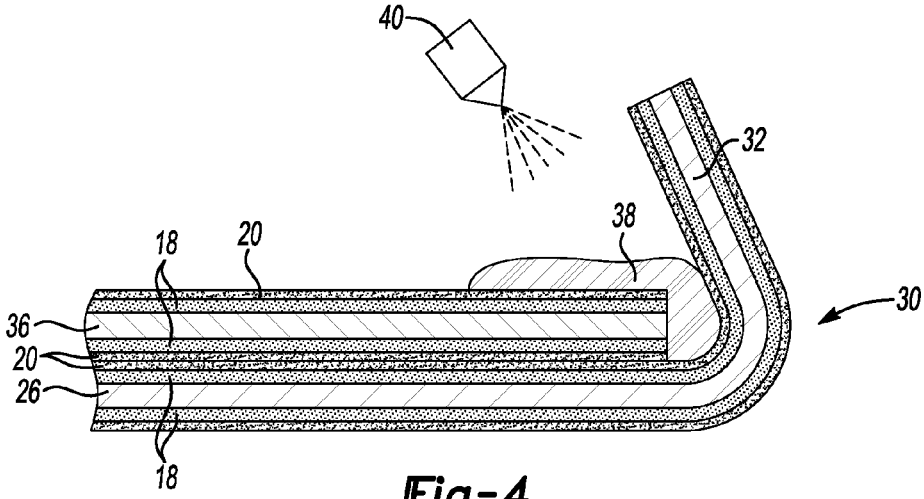
FIG. 4 is a fragmentary cross-sectional view of a partially formed hem flange on the blank as it is formed over an edge of an inner panel with a hem adhesive being applied to a portion of the blank and the panel.

Referring to FIG. 4, a partially formed hem flange 30 is illustrated as formed on the part 26. A flange 32 is shown with an inner panel 36 placed on the part 26 and a hem flange adhesive 38 is shown as it is applied by a nozzle 40 or other applicator to the partially formed hem flange 30. The hem flange adhesive 38 is deposited between the inner panel 36 and the outer panel of the part 26.

Figure 5:
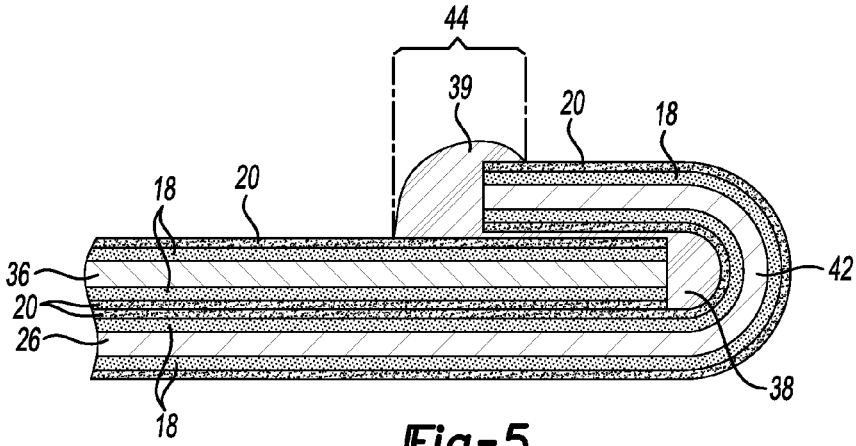
FIG. 5 is a fragmentary cross-sectional view of a fully formed hem flange on the blank formed over an edge of an inner panel with a hem flange sealant and a hem adhesive applied to the assembly.

Referring to FIG. 5, the part 26 is illustrated in cross-section with the fully formed hem flange 42. The fully formed hem flange 42 is formed on the part 26 with the inner panel 36 secured within the hem flange 42. The adhesive 38 is a hem flange adhesive that provides strength and rigidity to the hem flange 42. The hem flange adhesive 38 fills the hem flange 42 and is bonded to the thin film pretreatment layer 18 and dry lubricant layer 20 on the part 26 and inner panel 36.

The thin film pretreatment layer 18 and the dry lubricant layer 20 are intact on the surfaces of the part 26 and the inner panel 36. An over-hem sealer 39, or hem flange sealant, may be applied to the hem flange 42 that covers the thin film pretreatment layer 18 and the dry lubricant layer 20 in the area indicated by reference numeral 44.

Figure 6:
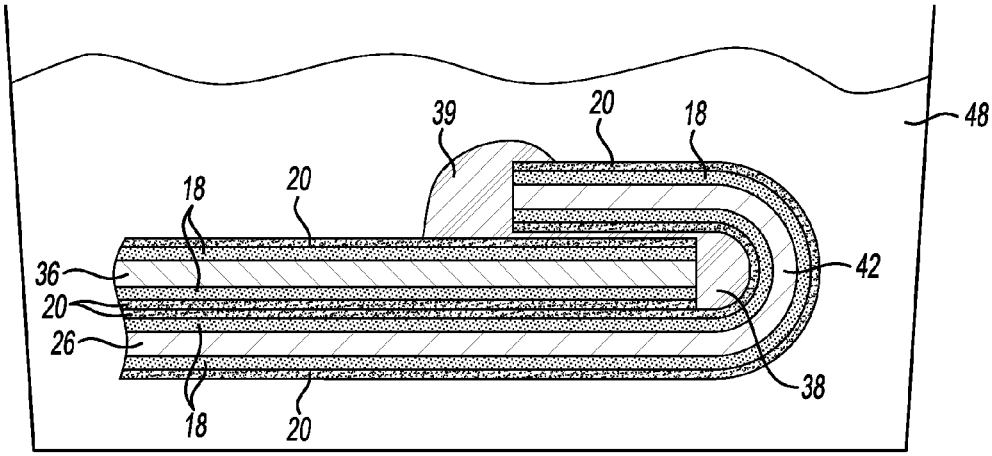
FIG. 6 is a diagrammatic cross-sectional view of the assembly including a hem flange immersed in a tank of a cleaner.

Referring to FIG. 6, the part 26 is diagrammatically shown to be immersed in an immersion bath 48. The cleaner could alternatively, or in addition, be applied by a spray applicator. The part 26 has a hem flange 42 that the hem flange adhesive 38 is bonded to and an over-hem sealant that prevent the thin film pretreatment layer 18 and the dry lubricant layer 20 from being acted upon by the alkaline (or acidic) cleaner and surfactants in an aqueous solution in the cleaner bath 48.

Figure 6A:
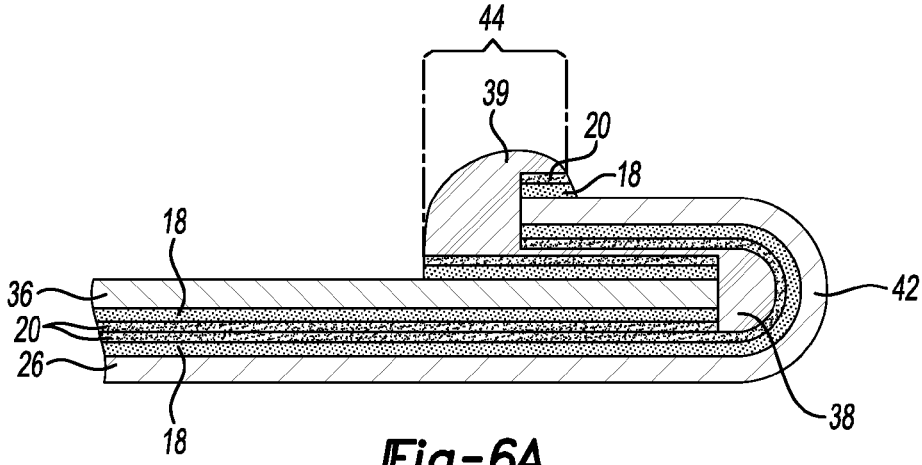
FIG. 6A is a cross-sectional view of the hem flange of FIG. 6 after the thin film pretreatment layer and the dry lubricant coating is removed from the exposed surfaces of the blank and inner panel and with thin film pretreatment layer and the dry lubricant coating intact where the hem flange sealant and the hem flange adhesive is applied to the blank and the inner panel.

Referring to FIG. 6A, the part 26 is shown with the selected area 44 including the deposit of over-hem sealer 39. The over-hem sealer 39 covers the thin film pretreatment layer 18 and the dry lubricant layer 20 in the area 44. The thin film pretreatment layer 18 is partially or fully removed from the other surfaces of the metal. The dry lubricant layer 20 is substantially removed by the cleaner from all other areas of the part 26 that are exposed to the cleaner in the cleaner bath 48.

Figure 7:
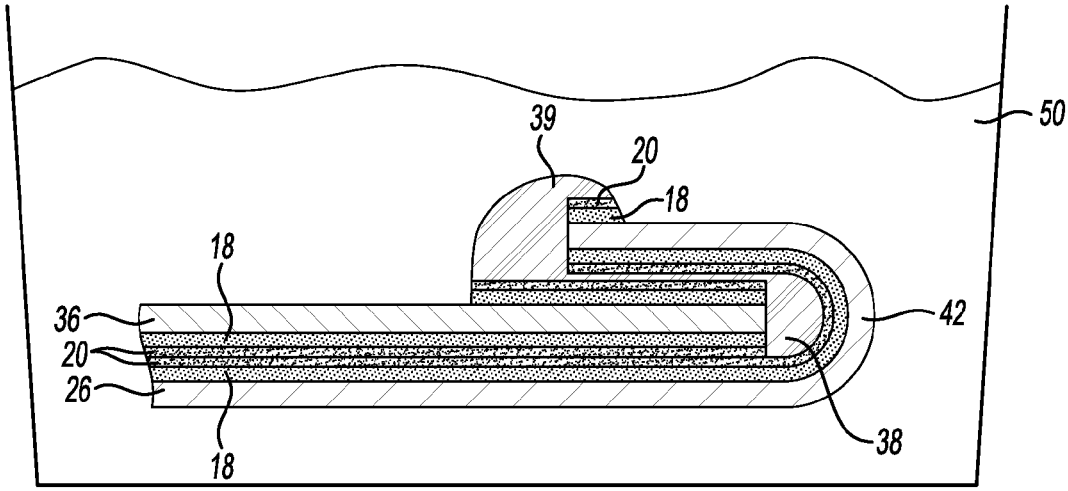
FIG. 7 is a diagrammatic view of the hem flange fragment being immersed in a tank of a thin film conversion coating process.

Referring to FIG. 7, a conversion coating immersion bath 50 is illustrated with the part 26 including the hem flange adhesive 38 and hem flange sealant 39 masking the part 26 where they are bonded to the part 26.

Figure 7A:
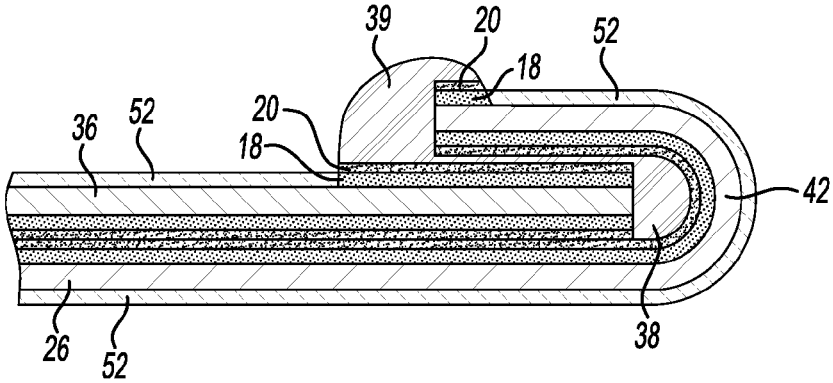
FIG. 7A is a cross-sectional view of the hem flange of FIG. 7 with a conversion coating applied to the exposed surfaces of the blank and inner panel.

Referring to FIG. 7A, a conversion coating 52 is diagrammatically illustrated covering exposed metal surfaces of the part 26 including the selected area 42. The thin film pretreatment layer 18 and the dry lubricant layer 20 are intact where they are covered by the adhesive 38. The thin film pretreatment layer 18 provides adhesive bond durability. The thin film pretreatment layer 18 and the dry lubricant layer 20 are effectively removed from the other portions of the surface of the part 26 to prepare the surface of the part 26 for the pretreatment conversion coating.

A method of pretreating an aluminum part 26 is disclosed that begins with selecting a blank 24 having a thin film pretreatment layer 18 and a lubricant coating 20 applied to a surface. The thin film pretreatment layer 18 is applied to the coil 10 that is cut to form the blank 24. The dry lubricant 20 may also be applied to the coil 10 to facilitate forming the blank 24 in a conventional sheet metal forming production process. The blank 24 is formed into a part 26. An adhesive 38 may be applied to the surface to provide structural strength and rigidity. The adhesive 38 is bonded to a selected area 42 of the surface, such as a joining area. The part 26 may then be cleaned in a paint shop or other cleaning process to partially or fully remove the thin film pretreatment layer 18 and substantially remove the lubricant coating 20 from the surface except at the selected portion 44. A conversion coating 52 is applied to the part 26 before painting.

In one embodiment, the thin film pretreatment layer 18 is a thin film formed by the reaction of vinyl phosphonic/phosphinic acid pretreatment with the native oxide/hydroxide layer. The type of surface oxide layer is important for achieving good bonding performance. For example, the thin film pretreatment layer 18 may be Alcoa 951, or another coating made in accordance with U.S. Pat. No. 5,059,258. Alcoa 951 is a trademark of Aluminum Company of America. It should be noted that over etching the oxide prior to application of Alcoa 951 may result in poor bond durability. A silane based adhesion promoter may be applied to the surface of the aluminum coil 10 or blank 24. Mixed metal oxide conversion coatings, such as Ti/Zr oxide film pretreatments, or Trivalent Cr ($Cr^{3+}$) conversion coatings may also be used.

The lubricant coating 20 may be a dry lubricant. In particular, the dry lubricant may be a dry lubricant that is a blend of mineral oil and paraffin wax. The lubricant coating 20 may be Quaker DryCote® 290. Quaker Drycote® is a trademark of Quaker Chemical Corporation. The composition of this dry lubricant is 30-40% by weight mineral oil, 30-40% paraffin wax (or hydrocarbon wax), 10-15% slack wax (petroleum), 1-5% calcium sulfonate, 1-5% ethoxylated alcohols c16-c18, and 1-5% sodium sulfonate.

The conversion coating 52 may be a thin film zirconium oxide coating. Other conversion coatings that may be used include zinc phosphate, a two-step zinc phosphate, or similar conversion coatings.

A system is disclosed for pre-treating an aluminum part 26 formed from a blank 24 that is coated with an thin film pretreatment layer 18 and a lubricant coating 20, as previously described. The part 26 has an adhesive 38 applied to a selected portion of the surface, such as at a structural joint or possibly a hem flange. The system comprises a cleaner immersion or spray tank 48 for applying a cleaner to the part to partially or fully remove the thin film pretreatment layer and the lubricant except at the portion 44 of the part 26 where the adhesive 38 is applied to the selected portion 48 of the surface 44. Next, a zirconium oxide conversion coating 52 is applied to the part 26 in subsequent immersion or spray tanks.

Several examples of different combinations that were tested are described below:

EXAMPLE 1

An assembly including a blank of 6111 aluminum alloy was pre-treated with zirconium oxide paint pretreatment and painted. The blank was scribed and subjected to 6 weeks in an accelerated corrosion test. After the test the extent of scribe creep averaged about 0.7 mm but the part failed formability and bond durability testing.

EXAMPLE 2

An assembly including a blank of 6111 aluminum alloy was pre-treated with a silane based adhesion promoter, dry lubricant Dry Cote 290, zirconium oxide paint pretreatment and painted. The blank was scribed and subjected to 6 weeks in an accelerated corrosion test. After the test the extent of scribe creep was about 2.5 mm but failed bond durability testing.

EXAMPLE 3

An assembly including a blank of 6111 aluminum alloy was pre-treated with a coil applied adhesion promoter Alcoa-951 and dry lubricant DryCote 290 received zinc phosphate paint pretreatment and painted. The blank was scribed and subjected to 6 weeks in an accelerated corrosion test. After the test the extent of scribe creep was about 4.0 mm and failed corrosion testing.

EXAMPLE 4

An assembly including a blank of 6111 aluminum alloy was pre-treated with dry lubricant DryCote 290 received zirconium oxide paint pretreatment and painted. The blank was scribed and subjected to 6 weeks in an accelerated corrosion test. After the test the extent of scribe creep was about 2.2 mm but failed bond durability testing.

EXAMPLE 5

An assembly including a blank of 6111 aluminum alloy was pre-treated with a coil applied adhesion promoter Alcoa-951 and dry lubricant DryCote 290. A cleaner is applied to the assembly to remove the thin film pretreatment layer and the lubricant coating from the surface. The assembly received zirconium oxide paint pretreatment and painted. The blank was scribed and subjected to 6 weeks in an accelerated corrosion test. After the test the extent of scribe creep was about 1.8 mm and passed all testing requirements for formability, bond durability, and corrosion resistance.

EXAMPLE 6

An assembly including a blank of 6111 aluminum alloy was pre-treated with a coil applied adhesion promoter Alcoa-951 and dry lubricant DryCote 290. The assembly received a two-step zinc phosphate paint pretreatment (or the DuPlex process) and painted. The blank was scribed and subjected to 6 weeks in an accelerated corrosion test. After the test the extent of scribe creep was about 1.6 mm and passed all testing requirements for formability, bond durability, and corrosion resistance. However, the two-step zinc phosphate pretreatment that is intended for high aluminum content was determined to be not feasible for full 100% aluminum content production applications.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A method comprising:

forming a part from a blank having a pretreatment layer and a lubricant coating applied to a surface;

applying an adhesive to a portion of the part over the pretreatment layer and the lubricant coating;

applying a cleaner to the part to remove the pretreatment layer and the lubricant coating from the surface except at the portion where the adhesive is applied; and applying a conversion coating to the part.

2. The method of claim 1 wherein the pretreatment layer and the lubricant coating are applied to a coil before the coil is cut to form the blank.

3. The method of claim 1 wherein the pretreatment layer is a layer formed by bonding a layer of vinyl phosphonic acid or vinyl phosphinic acid to an aluminum hydroxide layer.

4. The method of claim 1 wherein the lubricant coating is a dry lubricant.

5. The method of claim 1 wherein the lubricant coating is a dry lubricant that is a blend of mineral oil and paraffin wax.

6. The method of claim 1 wherein the portion of the part is a hem flange.

7. The method of claim 1 wherein the conversion coating is a thin film zirconium oxide coating.

* * * * *